US012312737B2

(12) United States Patent
Tagliapietra

(10) Patent No.: US 12,312,737 B2
(45) Date of Patent: May 27, 2025

(54) PROCESS FOR TREATING FIBRES OF VEGETABLE ORIGIN AND USE OF THE TREATED VEGETABLE FIBRES OBTAINED BY SAID PROCESS

(71) Applicant: MIXCYCLING S.R.L., Vicenza (IT)

(72) Inventor: Gianni Tagliapietra, Vicenza (IT)

(73) Assignee: MIXCYCLING S.R.L., Vicenza (IT)

( * ) Notice: Subject to any disclaimer, the term of this patent is extended or adjusted under 35 U.S.C. 154(b) by 0 days.

(21) Appl. No.: 18/553,862

(22) PCT Filed: Apr. 11, 2022

(86) PCT No.: PCT/EP2022/059662

§ 371 (c)(1),
(2) Date: Oct. 4, 2023

(87) PCT Pub. No.: WO2022/218940

PCT Pub. Date: Oct. 20, 2022

(65) Prior Publication Data

US 2024/0183103 A1 Jun. 6, 2024

(30) Foreign Application Priority Data

Apr. 12, 2021 (IT) ..... 102021000009125

(51) Int. Cl.

| | |
|---|---|
| ***D06M 11/76*** | (2006.01) |
| ***D06M 10/00*** | (2006.01) |
| ***D06M 10/02*** | (2006.01) |
| ***D06M 10/06*** | (2006.01) |
| *D06M 101/04* | (2006.01) |

(52) U.S. Cl.
CPC ..... *D06M 11/76* (2013.01); *D06M 10/003* (2013.01); *D06M 10/025* (2013.01); *D06M 10/06* (2013.01); *D06M 2101/04* (2013.01)

(58) Field of Classification Search
CPC ..... D06M 2101/04; D06M 11/76; D06M 10/003; D06M 10/025; D06M 10/06
See application file for complete search history.

(56) References Cited

U.S. PATENT DOCUMENTS

| | | | | |
|---|---|---|---|---|
| 2010/0058607 | A1 | 3/2010 | Franich | |
| 2010/0293969 | A1* | 11/2010 | Braithwaite | A23L 3/3463 62/62 |
| 2013/0156908 | A1* | 6/2013 | Sakai | A23B 7/10 426/335 |
| 2021/0170626 | A1 | 6/2021 | Santos | |
| 2022/0193955 | A1 | 6/2022 | Tagliapietra | |

FOREIGN PATENT DOCUMENTS

| | | | | |
|---|---|---|---|---|
| GB | 2438958 A | * | 12/2007 | H05B 6/62 |
| JP | 9-14585 | * | 1/1997 | F17C 1/00 |
| WO | WO 01/43555 A1 | * | 6/2001 | A23B 7/152 |
| WO | 2004113426 | | 12/2004 | |
| WO | WO 2012/051198 A1 | * | 4/2012 | B65D 81/34 |
| WO | 2014152291 | | 9/2014 | |

OTHER PUBLICATIONS

Guo, Chaofan, et al., "New Development in Radio Frequency Heating for Fresh Food Processing: a Review". Food Engineering Reviews (2019) 11:29-43.*

Dong, Jinlong, et al., "Effects of Elevated CO2 on Nutritional Quality of Vegetables: A Review". Frontiers in Plant Science, vol. 9, Article 924, Aug. 2018, pp. 1-11.*

Altemimi, Ammar, et al., "Critical review of radio-frequency (RF) heating applications in food processing". Food Quality and Safety, 2019, 3, 81-91.*

Kariya, Shuji, et al., "Radiofrequency Ablation Combined with CO2 Injection for Treatment of Retroperitoneal Tumor: Protecting Surrounding Organs Against Thermal Injury". American Journal of Roentgenology, vol. 185, Issue 4, Oct. 2005, pp. 890-893.*

Bermudez-Aquirre, Daniela, et al., "Radio Frequency Treatment of Food: A Review on Pasteurization and Disinfestation". Foods, 2023, 3057, pp. 1-23.*

Silva, Eric Keven, et al., "Supercritical carbon dioxide technology: A promising technique for the non-thermal processing of freshly fruit and vegetable juices". Trends in Food Science & Technology vol. 97, Mar. 2020, pp. 381-390.*

Duan, Chao, et al., "Chitosan as A Preservative for Fruits and Vegetables: A Review on Chemistry and Antimicrobial Properties". Journal of Bioresources and Bioproducts. 2019, 4(1): 11-21.*

Anonymous, "AT Superstudio Magazine—Mixcycling: organic waste into materials", (Feb. 11, 2021), URL: https://www.at-superstudiomagazine.com/en/mixcyclingorganicwasteintomaterials, (Dec. 9, 2021), XP055871422 [AD] 1.

(Continued)

*Primary Examiner* — Bret P Chen
(74) *Attorney, Agent, or Firm* — DUANE MORRIS, LLP; Gregory M. Lefkowitz

(57) ABSTRACT

This is a process for treating fibres of vegetable origin, comprising the following steps:

heating the vegetable fibres by means of a radiofrequency heating oven into which an air flow previously treated with cold plasma is introduced;

subjecting the vegetable fibres to a high vacuum treatment;

impregnating the vegetable fibres with $CO_2$;

mixing the vegetable fibres with a binding agent.

The invention also relates to the use of the treated vegetable fibres obtained by said process.

17 Claims, 1 Drawing Sheet

(56) References Cited

OTHER PUBLICATIONS

Anonymous, "Bio-Materials: Mixcycling, Innovative Start-Up That Offers Concretely Sustainable Materials for a New Bio-Economy", (Feb. 1, 2020), URL: https://editions.fuorisalone.it/2020/uploads/fuorisalone/attachments/events/events_m/108/files/downloadable_files/26/cartella_stampa_2020_eng.pdf, (Dec. 9, 2021), XP055871418 [AD] 1.

Padungthon S et al., "Carbon dioxide sequestration through novel use of ion exchange fibers (IX-fibers)", Chemical Engineering Research and Design, Elsevier, Amsterdam, NL, vol. 89, No. 9, doi:10.1016/J.CHERD.2010.11.012, ISSN 0263-8762, (Nov. 23, 2010), pp. 1891-1900, (Dec. 5, 2010), XP028268568 [AD] 1.

Mastali M et al. "Carbon dioxide sequestration of fly ash alkaline-based mortars containing recycled aggregates and reinforced by hemp fibres", Construction and Building Materials, Elsevier, Netherlands, (Nov. 29, 2017), vol. 160, doi:10.1016/J.CONBUILDMAT.2017.11.044, ISSN 0950-0618, pp. 48-56, XP085347627 [AD] 11.

* cited by examiner

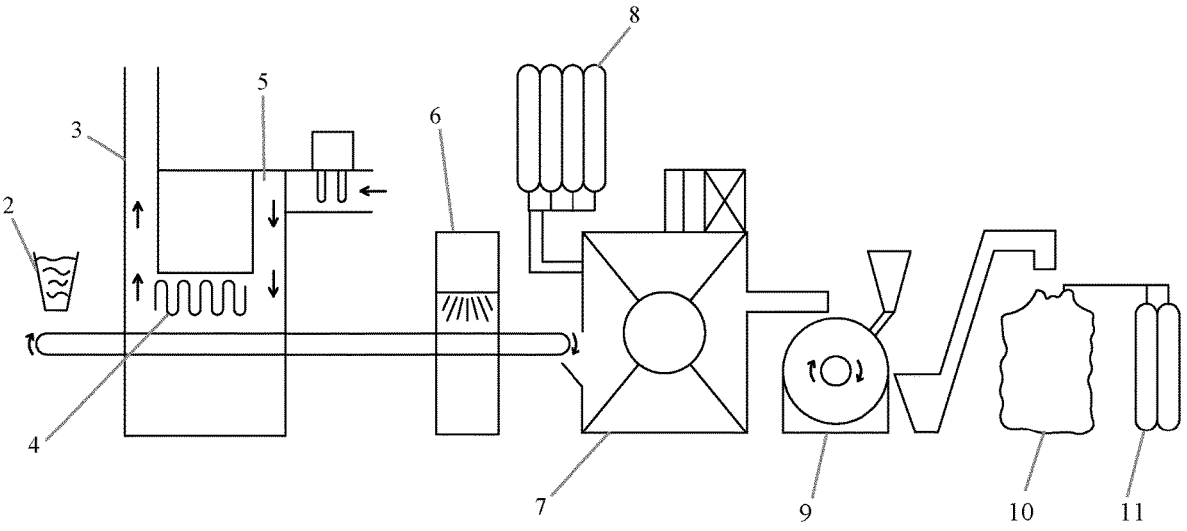
8
5
6
3
2
4
7
9
10
11

PROCESS FOR TREATING FIBRES OF VEGETABLE ORIGIN AND USE OF THE TREATED VEGETABLE FIBRES OBTAINED BY SAID PROCESS

CROSS-REFERENCE TO RELATED APPLICATIONS

This application is a § 371 national stage entry of International Application No. PCT/EP2022/059662, filed Apr. 11, 2022, which claims priority to Italian Application No. 102021000009125, filed Apr. 12, 2021, the entire contents of which are incorporated herein by reference.

The present invention relates to a process for treating fibres of vegetable origin and to the use of the treated vegetable fibres obtained by said process.

Nowadays it is of primary importance to fight the greenhouse effect as much as possible, due to the human input of gases such as $CO_2$ and $CH_4$ (carbon dioxide and methane) into the earth's atmosphere that prevent the dissipation of heat from the sun into space. This results in a steady increase in the earth's average temperatures, with a consequent melting of the polar caps, rising seas and climate change.

In order to curb the effects of greenhouse gases, there is an increasing pressure to use alternative energy sources to fossil fuels, such as solar or wind power, and materials with minimal environmental impact.

The latter category includes vegetable fibres. The term vegetable fibre means any type of product, by-product or waste of vegetable origin, thus comprising a wide variety of options such as cork, wood sawdust, rice husk, grape marc, bamboo, Indian hemp, coffee parchment.

It is known that approximately every kg of dehumidified vegetable fibre is composed of about 50% carbon (C), which is formed thanks to the process of chlorophyll photosynthesis, whereby thanks to sunlight carbon dioxide ($CO_2$) is combined with water ($H_2O$) obtaining glucose ($C_6H_{12}O_6$).

Approximately 3.6 kg of $CO_2$ are required for the synthesis of 1 kg of carbon. So, it can be said that the dry fraction of the vegetable fibre is able to "sequester" about 1.8 kg of $CO_2$ in its inside, which will be kept inside the vegetable fibre until the decomposition process (bacterial or by combustion) takes place, which will return $CO_2$ into the atmosphere.

It is therefore clear that vegetable fibres can be intended as a promising medium for storing $CO_2$ in the long term, thus preventing it from persisting in the atmosphere. However, vegetable fibres, in order for them to be used in products with commercial outlets, must first be processed in such a way as to promote their compatibility with the materials to which they are to be mixed.

To date, the few fields of application for vegetable fibres involve coarse refining before their use. For example, the fibres are roughly dried using high energy-intensive systems such as drums with hot air generated by burning fossil fuels. This type of process does not allow the right amount of humidity to be removed from the fibres, which in many cases are damaged, thus becoming less suitable for commercial use. In addition, the fibres are not activated, i.e. their surface does not have the suitable porosity to be able to absorb other materials to which the fibres will be mixed.

The most significant document of the state of the art is WO 2020/182660 A1, whose applicant is the same as this patent application.

The following additional state-of-the-art documents are also cited: WO 2008/091163 A1, Anonymous: "AT Superstudio Magazione—Mixcycling: organic waste into materials", Anonymous: "BIO-MATERIALS: MIXCYCLING, INNOVATIVE START-UP THAT OFFERS CONCRETELY SUSTAINABLE MATERIALS FOR A NEW BIO-ECONOMY", WO 2004/113426 A1, WO 2019/053671 A1, WO 2014/152291 A1, PADUNGTHON S ET AL: "Carbon dioxide sequestration through novel use of ion exchange fibers (IX fibers)", MASTALI M ET AL: "Carbon dioxide sequestration of fly ash alkaline-based mortars containing recycled aggregates and reinforced by hemp fibres".

The main aim of the present invention is to provide a process for treating vegetable fibres that allows them to be mixed with other materials in order to achieve the construction of medium or long life goods in such a way as to move the decomposition phase forward in time, avoiding as long as possible the release into the atmosphere of $CO_2$ present within said fibres.

Furthermore, a further aim of the invention is to give rise to a process capable of allowing better results in relation to the treatment of vegetable fibres than those obtainable using the process described in WO 2020/182660 A1.

Finally, the invention also relates to the use of the vegetable fibres obtained by said process.

The water contained within the vegetable fibres will be extracted by the process according to the invention so that it can be returned to the ecosystem. The process according to the invention is further able to be carried out without the aid of fossil fuels, significantly reducing its environmental impact.

The invention will be better defined through the description of a possible embodiment thereof, given solely by way of non-limiting example, with the aid of the attached drawing, wherein:

FIG. 1 illustrates a system set up to carry out the process referred to in the invention.

The treatment process according to the invention provides for the process of vegetable fibres which may advantageously be less than 5 cm in size.

Normally, the fibres themselves have a residual humidity content comprised between 5 and 20%, before they undergo a drying process.

The process achieves optimal results if the vegetable fibres are previously allowed to dry so as to have a relative humidity not exceeding 12%, which can be obtained simply by natural air drying, which does not require energy and therefore does not pollute.

It should be emphasised that the lower is the humidity content of the vegetable fibres prior to the process, the less energy will be required to bring the product to a target value, e.g. a relative humidity of less than 1% compared to the total mass of processed fibres.

Advantageously, a conveyor belt 1 can be used to move the fibres between some steps of the process. The conveyor belt 1 can have a length from 50 to 200 cm. The vegetable fibres are placed on said belt 1 forming a layer from 1 cm to 15 cm thick. The overall thickness varies depending on the gaseous exchange capacity required for humidity evacuation; the lower is the gaseous exchange, the lower is the required thickness.

In a particular configuration of the process according to the invention, the conveyor belt 1 carries the vegetable fibres from a distribution device 2 to a first radiofrequency heating oven 3. This is suitable for deep dehumidification of the fibres by means of an electromagnetic field 4 oscillating at frequencies in the order of MHz. This electromagnetic field 4 is able to generate heat within the entire volume of the vegetable fibres, causing the water molecules present within them to vibrate/rotate. Humidity must be removed as it is a pollutant that reduces the quality of the final agglomerate obtained by mixing the fibres with other materials.

Water molecules, as electrical dipoles, are sensitive to oscillating electric fields, which, by constantly changing their direction, induce the molecules to repeatedly change their orientation according to the frequency of the fields. The excited molecules transfer the motion to the rest of the matter constituting the vegetable fibres through collisions, thus achieving heating.

Through said heating oven 3 it is possible to achieve uniform heating and drying in an extremely fast time, if compared to traditional techniques.

As mentioned above, the latter use fossil fuels to heat large masses of air that are blown onto the vegetable fibres. This means that the heat is first brought to the outer surfaces of the fibres, through which it will spread up to their interior. Obviously, this diffusion is much slower and less efficient than generating heat directly inside the fibres obtained through the oscillating electromagnetic field 4. This ensures high energy efficiency.

Other advantages of using radiofrequency heating are the reduction of the growth of microbes inside the fibres thanks to the fast drying times and the fact of avoiding generating mechanical damage to the product.

While inside the radiofrequency heating oven 3 the fibres are subjected to a flow of air previously treated with cold plasma 5 using a technology called NTP (Non Thermal Plasma) or VOCLESS, which is based on the principle of advanced oxidation.

The term plasma refers to a mixture of ionised gases consisting of a considerable amount of charged particles, such as ions or electrons, free radicals, ros, molecules and even neutral atoms. The ionisation of an atom occurs when an electron acquires sufficient energy to overcome the attractive forces of the atom's nucleus. When this is achieved by processes that generate a plasma in which the temperature of the ions and neutral atoms is significantly lower than that of the electrons, we speak of cold plasma or NTP. Cold plasma emits light with wavelengths in both the visible and ultraviolet parts of the spectrum. In addition to the emission of UV radiations, an important property of low-temperature plasma is the presence of highly reactive high-energy electrons, which generate numerous chemical and physical processes such as oxidation, excitation of atoms and molecules, production of free radicals and other reactive particles. A plasma can be generated artificially by supplying a gas with sufficiently high energy, i.e. by applying energy to a gas in such a way as to rearrange the electronic structure of species (atoms, molecules) and produce excited species and ions. One of the most common ways of artificially creating and maintaining a plasma is through an electrical discharge in a gas. Advantageously, the process according to the invention can use non-thermal discharges with a dielectric barrier discharge (DBD) method for this purpose. The ionisation potential and the density of charged species generated by plasma with dielectric barrier discharge are greater than those present in the non-thermal plasma generated by other systems.

This air flow previously treated with cold plasma 5 has multiple functions:

- constantly reduces and eliminates the bacterial loads present in the air and on the surfaces and inside the porosity of the materials;
- constantly decomposes volatile organic compounds (VOC);
- eliminates unpleasant odours;
- alters the surface tension of the fibres, making them more prone to aggregation with other materials;
- removes the humidity generated by the fibres subjected to the radiofrequency heating process, thus preventing it from being trapped inside the fibres, returning it to the atmosphere.

All these functions are achieved without the use of chemicals, making the process extremely environmentally friendly.

The process may comprise a step in which the fibres are subjected to a plasma-based treatment within a specific plasma generator 6 in order to activate, i.e. change the surface characteristics of the tougher fibres. This is a more aggressive treatment than the one with the air flow previously treated with cold plasma 5, but which does not alter the technical characteristics of the fibres. Advantageously, the aforesaid conveyor belt 1 may be used to transport the vegetable fibres from the radiofrequency heating oven to the plasma generator 6 used for the present step.

As described above, the plasma comprises a large amount of charged particles and therefore has a state of aggregation at a high energy level. Plasma is often regarded as the fourth state of matter, and on contact with solid materials such as vegetable fibres and polymers, it is able to give them its energy by striking their surface, altering the surface energy thereof.

It is customary to exploit this principle to change the characteristics of the materials appropriately. Pre-treatment with plasma energy consistently and precisely increases the adhesiveness and wettability of the surfaces. It therefore enables the industrial use of innovative (even non-polar) materials such as vegetable fibres.

Subsequently, by advantageously using the conveyor belt 1 described above, the vegetable fibres are loaded inside a high vacuum apparatus 7, inside which pressures ranging from 10-2 to 10-8 bars and a temperature capable of helping the sublimation of the gases, at least 40° C., and such as not to compromise the structure of the fibres, at most 150° C., are advantageously present.

In this step, the vegetable fibres are refined, eliminating any residual pollutants in depth and are deprived of all the gases present inside them.

Advantageously, in some cases flushing with gases such as Hydrogen, Helium, Nitrogen, Argon or mixtures of these gases may be necessary in order to achieve a complete sanitisation.

At the end of the process, before returning to ambient conditions, $CO_2$ is injected into the apparatus 7 so that the fibres are impregnated with it in order to trap it and increase the "sequestration" that will take place in the final material. This is followed by an impregnation time lasting from 10 to 60 minutes, allowing all the cavities in the vegetable fibres to be filled with gas. Both the gases for flushing and $CO_2$ can be contained in cylinders 8 connected to the high vacuum apparatus 7.

The duration of the treatment depends on various factors, such as the pressures to be achieved, the gas flushing temperature and the $CO_2$ impregnation step. The total duration can range from about 1 h up to 12 h.

This process also allows the heat treatment of vegetable fibres and consequently the stabilisation of some types of vegetable fibres to make them last in a better way over time.

In a particular embodiment of the process according to the invention the high vacuum apparatus 7 may comprise within it a radiation heating over (not illustrated for simplicity's sake). In this way, residual humidity in the fibres is eliminated even in this step. Heating by irradiation is necessary because there is no air inside the high vacuum apparatus 7 which can convey heat transmission by conduction.

At the end of these treatments, the fibres are mixed with a binding agent; advantageously, this binding agent will be of polymeric origin, of chemical origin (polyolefins, polycaprolactam, etc.) or of natural origin (cellulose, rubber, latex, etc.) or of any other origin, so that it is compatible with vegetable fibres.

Sanitisation of the fibres is then carried out, which is essential due to the fact that this material is prone to bacterial contaminations; this sanitisation is advantageously based on the principle of advanced oscillation and is carried out by means of the innovative technology called "Non-thermal plasma" or "NTP" which uses the so-called "Non-thermal discharges with dielectric barrier method" or "DBD".

Operationally, the ionisation potential and the density of the charged species obtained with this innovative technology are greater than those found in "non-thermal plasma" generated with other systems, so that a beneficial treatment is carried out with which bacterial charges are greatly reduced, to the point of elimination, volatile organic substances (VOC) are decomposed and odours are eliminated. In addition, absolutely not secondarily, no chemical products are used, thus resulting in a totally ecological treatment.

The purpose of this mixing is to create a coating on the fibres that avoids or limits the permeability of $CO_2$ from the inside to the outside or to facilitate agglomeration thereof with other materials.

A further aim is to be able to obtain solid materials starting from the treated vegetable fibres at a later stage, either through a hot pressing process that involves the melting of the polymers in order to make the vegetable fibres cohesive with each other, or through catalysing processes at ambient temperature. The materials in both cases can be placed inside a mould to obtain the desired shapes and in any case the component of vegetable fibres will be dominant and the "chemical" component will be minor thanks to the treatment process that involved the fibres.

Basically, said process changes the surface tension state of the fibres and makes it more suitable for adhesion; in this way the percentage of adhesive present in the compound used to obtain fibre cohesion can be reduced.

After mixing, the fibres can be advantageously placed in a sieve 9 into which the binding agent is poured.

The final result of the process is a semi-finished product of vegetable origin rich in carbon and impregnated with $CO_2$ that can be used to obtain different types of highly sustainable materials with which to produce any type of object: the longer the object lasts, the longer the $CO_2$ sequestration and consequently the more effective the environmental benefit will be.

In order to store vegetable fibres properly before their final use, it is preferable to store them properly in high resistance bags 10.

These are formed by at least two layers of polymers that comprise an aluminium core between them, which increases the resistance of the bag 10 and gives it a barrier effect to prevent gas exchange between the fibres and the external environment. Inside the bag 10 there is an additional envelope in non-woven fabric containing clay and silica gel, which is intended to capture any residual humidity still inside the fibres or coming from outside.

From an operational point of view, particularly significant results were obtained by using "high resistance" bags with the following barrier properties:

ASTM D3985-95 (23° C.—0% rh) Oxygen Permeability <0.1 cc/m2/24 h (23° C.—0% r.h.)

ASTM F1249-90 (38° C.—90% rh) Moisture Permeability <0.1 g/m2/24 h (38° C.—90% r.h.)

The natural atmosphere inside the packaging can be replaced with a $CO_2$-based atmosphere in order to avoid or limit the migration of $CO_2$ present inside the fibres to the outside. The end-user will use the fibres once he has opened the packaging in which they have been fully impregnated with $CO_2$. This can be introduced into one or more high resistance bags 10 by means of a $CO_2$ applicator 11.

It should be noted that in order to check the size of the processed vegetable fibres, one or more of the following operations may be carried out at any time during the process according to the invention:

Grinding: mills with different technology are used depending on the type of fibre (dry, oily, etc.) and is intended to bring the fibre to the desired size.

Size screening: sieves are used to divide the fibres into different size classes, for example: 0-0.2 mm, 0.2-0.5 mm, 0.5-2.0 mm.

Densimetric screening: by using inclined vibrating planes or "ballistic" separators, the fibres of the same size are divided into different classes of specific weight, for example cork that usually has a size of 0.5-1.0 mm can have a specific weight ranging from 40 to 50 kg/m3, from 50 to 60 kg/m3, from 60 to 80 Kg/m3.

The fibres obtained by the process described above can be incorporated as a filler or as a structural part in plastics, bioplastics, resins, paper products, concrete for construction or asphalt. All the steps illustrated for the present invention are low energy consumption and can be carried out entirely using only electrical energy, thus making it possible to use renewable energies to minimise the environmental impact of the process referred to in the invention.

In fact, this process involves using vegetable fibres as $CO_2$ sequestrants. The greater is the amount of $CO_2$ that can be stored in the fibres, the smaller is its amount that remains in the environment, obviously reducing proportionally the effects that $CO_2$ has on global warming.

It is undisputed that, in absolute terms, the amount of $CO_2$ that can be sequestered in the vegetable fibres treated with the process referred to in the invention is rather small, but it is clear that a possible contribution to the reduction of $CO_2$ emissions in the specific field of use of vegetable fibres is still obtained contributing, as far as possible, to the sustainability of the use of vegetable fibres.

The invention claimed is:

1. Process for treating fibres of vegetable origin, comprising the following steps:

heating the fibres of vegetable origin by means of a radiofrequency heating oven into which an air flow previously treated with cold plasma is introduced;

subjecting the fibres of vegetable origin to a vacuum treatment;

impregnating the fibres of vegetable origin with CO2;

mixing the fibres of vegetable origin with a binding agent, storing the fibres of vegetable origin in an air-tight and moisture-tight bag in order to prevent gases exchange between the fibres and an external environment.

2. Process, according to claim 1, wherein, before the impregnation step with CO2, the fibres of vegetable origin are flushed by gases.

3. Process, according to claim 2, wherein gases comprise hydrogen, helium, nitrogen, argon or mixtures thereof.

4. Process, according to claim 1, wherein, after the treatment step of the fibres of vegetable origin in the radiofrequency heating oven, said fibres are inserted in a plasma generator, to be subjected to a treatment made from plasma.

5. Process, according to claim 1, wherein the binding agent applied to the fibres surface is a polymer.

6. Process, according to claim 5, wherein the binding agent consists in polyolefins, polycaprolactam, cellulose, rubber or latex.

7. Process, according to claim 1, wherein the air-tight and moisture-tight bag is formed by at least two layers of polymers that comprise an aluminium core between them.

8. Process, according to claim 1, wherein the binding agent is sprayed onto the fibers of vegetable origin, while the fibers of vegetable origin pass through a rotating sieve.

9. Process, according to claim 1, wherein the fibres of vegetable origin are placed on a continuous transport device so as to move them starting from a distribution device of raw fibres of vegetable origin, through the radiofrequency heating oven and then a plasma generator.

10. Process, according to claim 9, wherein the continuous transport device is a conveyor belt.

11. Process, according to claim 1, wherein the fibres of vegetable origin to be treated have a maximum size of 5 cm and a water content lower than 12% with respect to the total mass of the fibres of vegetable origin to be treated.

12. Process, according to claim 1, wherein a further sanitizing step of the fibres of vegetable origin by means of advanced oxidation, which is carried out using non-thermal plasma, which uses non-thermal discharges with dielectric barrier method.

13. Process, according to claim 1, wherein the fibres are stored in the air-tight and moisture-tight bag having the following barrier property:

ASTM D3985-95 (23° C.—0% rh) Oxygen Permeability<0.1 cc/m2/24 h (23° C.—0% r.h.).

14. Process, according to claim 1, wherein the fibres are stored in the air-tight and moisture-tight bag having the following barrier property:

ASTM F1249-90 (38° C.—90% rh) Moisture Permeability<0.1 g/m2/24 h (38° C.—90% r.h.).

15. Process, according to claim 1, wherein the air-tight and moisture-tight bag contains a $CO_2$-based atmosphere replacing the natural atmosphere.

16. Process, according to claim 1, wherein the air-tight and moisture-tight bag provides a further envelope in non-woven fabric containing a humidity absorber.

17. Process whereby use of fibres of vegetable origin, at the end of the treatment process, according to claim 1, once incorporated as a filler or as a structural part in plastic, bioplastic, resin, paper products, concrete for construction or asphalt.

* * * * *